US006295695B1

(12) United States Patent
Park

(10) Patent No.: US 6,295,695 B1
(45) Date of Patent: Oct. 2, 2001

(54) VACUUM CLEANER

(75) Inventor: Jung-seon Park, Kwangju (KR)

(73) Assignee: SamSung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/552,682

(22) Filed: Apr. 19, 2000

(30) Foreign Application Priority Data

Jun. 4, 1999 (KR) ..... 99-20700

(51) Int. Cl.[7] ..... A47L 9/00
(52) U.S. Cl. ..... 15/339; 15/412
(58) Field of Search ..... 15/339, 319, 412

(56) References Cited

U.S. PATENT DOCUMENTS

| | | | | |
|---|---|---|---|---|
| 4,852,208 | | 8/1989 | Morishita et al. . | |
| 4,907,316 | * | 3/1990 | Kurz | 15/339 X |
| 5,075,922 | * | 12/1991 | Tsuchida | 15/339 |
| 5,185,903 | * | 2/1993 | Choi | 15/339 |

FOREIGN PATENT DOCUMENTS 1097426 4/1989 (JP) .
3168112 7/1991 (JP) .

* cited by examiner

*Primary Examiner*—Chris K. Moore
(74) *Attorney, Agent, or Firm*—Robert E. Bushnell, Esq.

(57) ABSTRACT

A vacuum cleaner capable of exterminating bacteria or bugs that exist in the air sucked into a dust collecting chamber thereof. An exterminating section includes: an operating switch for selecting hot air circulation for exterminating operation; an hot air circulating duct disposed on a rear surface of a front body, connecting an accommodating chamber with a dust collecting chamber of the body, for guiding the air in the accommodating chamber into the dust collecting chamber; and a shutter section for circulating the air of the dust collecting chamber within the body of the vacuum cleaner by closing a suction port so as to prevent the outside air from being sucked into the dust collecting chamber through the suction port when the exterminating function is selected. Accordingly, by the air which is heated by a driving motor accommodated in the accommodating chamber, and is re-circulated to the dust collecting chamber through the hot air circulating duct, the various bacteria or the bugs living in the dust collecting chamber or on a filter are exterminated, and the sanitary condition of the vacuum cleaner is improved.

7 Claims, 5 Drawing Sheets

VACUUM CLEANER

CLAIM OF PRIORITY

This application makes reference to, incorporates the same herein, and claims all benefits accruing under 35 U.S.C. §119 from an application for UPRIGHT TYPE VACUUM CLEANER earlier filed in the Korean Industrial Property Office on Jun. 4 1999 and there duly assigned Serial No. 20700/1999.

BACKGROUND OF THE INVENTION

1. Field of the Invention

The present invention relates to a vacuum cleaner, and more particularly to a vacuum cleaner capable of sterilizing various bacteria and bugs living in a dust collecting chamber thereof by circulating hot ambient air from a motor inside the dust collecting chamber.

2. Description of the Prior Art

Generally, a vacuum cleaner collects dirts or filth in the air by inhaling the air with a strong suction force which is generated due to a high pressure difference between an interior and an exterior of a body of the vacuum cleaner while the interior is sufficiently vacuumized by a motor. As the air is sucked into/let out of the body of the vacuum cleaner, the dirt or filth in the air is filtered out by a filter which is disposed within the body of the vacuum cleaner. Such a vacuum cleaner is divided into canister type, upright type, stick type, and handy type, according to the shapes thereof.

Among the above various types of the vacuum cleaner, the upright type vacuum cleaner has a suction brush 20 that is directly connected to a lower portion of the body 10 of the vacuum cleaner, as shown in FIG. 1. On the upper inner side of the body 10, a dust collecting chamber 12 having a filter 171 mounted thereon is formed, while on the lower inner side of the body 10, an accommodating chamber 13 for accommodating a motor (not shown) that generates the suction force is formed. The dust collecting chamber 12 and the accommodating chamber 13 are communicated with each other. On the front portion of the accommodating chamber 13, an exhaust port 14 is formed to let the air outside. As the motor is driven, the strong suction force is generated in the dust collecting chamber 12. A suction port 16 and the suction brush 20 formed on the body 10 of the vacuum cleaner are communicated with the dust collecting chamber 12, and are connected with each other by a suction hose (not shown). Accordingly, the air is sucked through the suction brush 20, passes through the dust collecting chamber 12 and the accommodating chamber 13, and is then let outside, while the dirt or filth in the air is filtered out by the filter 11 disposed in the dust collecting chamber 12. A reference numeral 18 refers to a front cover.

The conventional vacuum cleaner, however, has no separate device to handle various bacteria or bugs which are sucked together with the air, and once the bacteria or bugs come into the vacuum cleaner, it is easy for bacteria or the bugs to live in the dust collecting chamber 12 and/or the filter 11, and to deteriorate the sanitary conditions of the vacuum cleaner. Since the interior of the body 10 usually provides optimum conditions for the bacteria or bugs to exist, it is hard to sterilize the vacuum cleaner, and a user has the risk of catching disease.

SUMMARY OF THE INVENTION

The present invention has been developed to overcome the above-mentioned problems of the prior art, and accordingly it is an object of the present invention to provide a vacuum cleaner capable of exterminating bacteria or bugs sucked into the vacuum cleaner that live in the dust collecting chamber or filter by using hot ambient air from a motor.

The above object is accomplished by a vacuum cleaner built according to the present invention including a body, a suction brush, a suction hose, and an exterminating section.

The body of the vacuum cleaner includes front and rear bodies which are coupled with each other to form a dust collecting chamber having a filter mounted inside, and an accommodating chamber for accommodating a motor for generating a suction force. A suction port is formed on the rear body, and a communicating hole corresponding to the suction port is formed on the front body for connecting the suction port with the dust collecting chamber.

The suction brush is connected to the lower portion of the body, and inhales the outside air with the various foreign substances from the cleaned surfaces as the motor is driven.

The suction hose is disposed between the suction brush and the suction port to guide the outside air containing the foreign substances sucked through the suction brush into the dust collecting chamber of the body.

The exterminating section sterilizes the various bacteria and the bugs living in the dust collecting chamber or on the filter by re-circulating the hot air heated by the motor into the dust collecting chamber of the body. The exterminating section includes: an operating switch for selecting an exterminating function of calculating hot air for exterminating various bacteria and the bugs; a hot air circulating duct disposed on that rear surface of the front body, connecting the accommodating chamber with the dust collecting chamber of the body, for guiding the air in the accommodating chamber into the dust collecting chamber; and a shutter section for circulating the air of the dust collecting chamber within the body of the vacuum cleaner by closing the suction port so as to prevent the outside air from being sucked into the dust collecting chamber through the suction port when the exterminating function is selected.

Further, the vacuum cleaner according to the preferred embodiment of the present invention further includes a temperature sensor for detecting the temperature of the air which circulates inside the body of the vacuum cleaner, and for stopping the operation of the motor when detecting the temperature of the air above a predetermined degree, thereby canceling the exterminating function. Here, the predetermined temperature ranges from 63° C. to 67° C.

The hot air circulating duct includes: a duct groove extending along the rear surface of the front body from the accommodating chamber to the communicating hole; and a duct cover for forming an air passage extending from the accommodating chamber to the dust collecting chamber by covering the duct groove, the duct cover having a guiding tube integrally formed on an upper end thereof which is positioned between the suction port of the rear body and the communicating hole of the front body.

The shutter section includes: a shutter member movably disposed on the rear body to be slid between the suction port of the rear body and the guiding tube of the duct cover for selectively closing the suction port; a pair of guiding members formed on the rear body for guiding the sliding movement of the shutter member; and an operating lever protruded from one side of the shutter member and passed through a guiding long hole formed on the rear body for allowing the user to slide the shutter member by holding the operating lever.

Further, the operating switch is turned on/off by the sliding movement of the shutter member.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIGS. 4 and 5 are perspective views for showing the structure and operational status of another main portion of the present invention, i.e., a shutter member of FIG. 2, in which FIG. 4 shows a suction port being opened, and FIG. 5 shows the suction port being closed, i.e., the sterilization function being selected.

DETAILED DESCRIPTION OF THE PREFERRED EMBODIMENT

Hereinafter, the preferred embodiment of the present invention will be described in greater detail with reference to the accompanied drawings.

FIGS. 2 through 5 show a vacuum cleaner built according to a preferred embodiment of the present invention.

Figure 2:
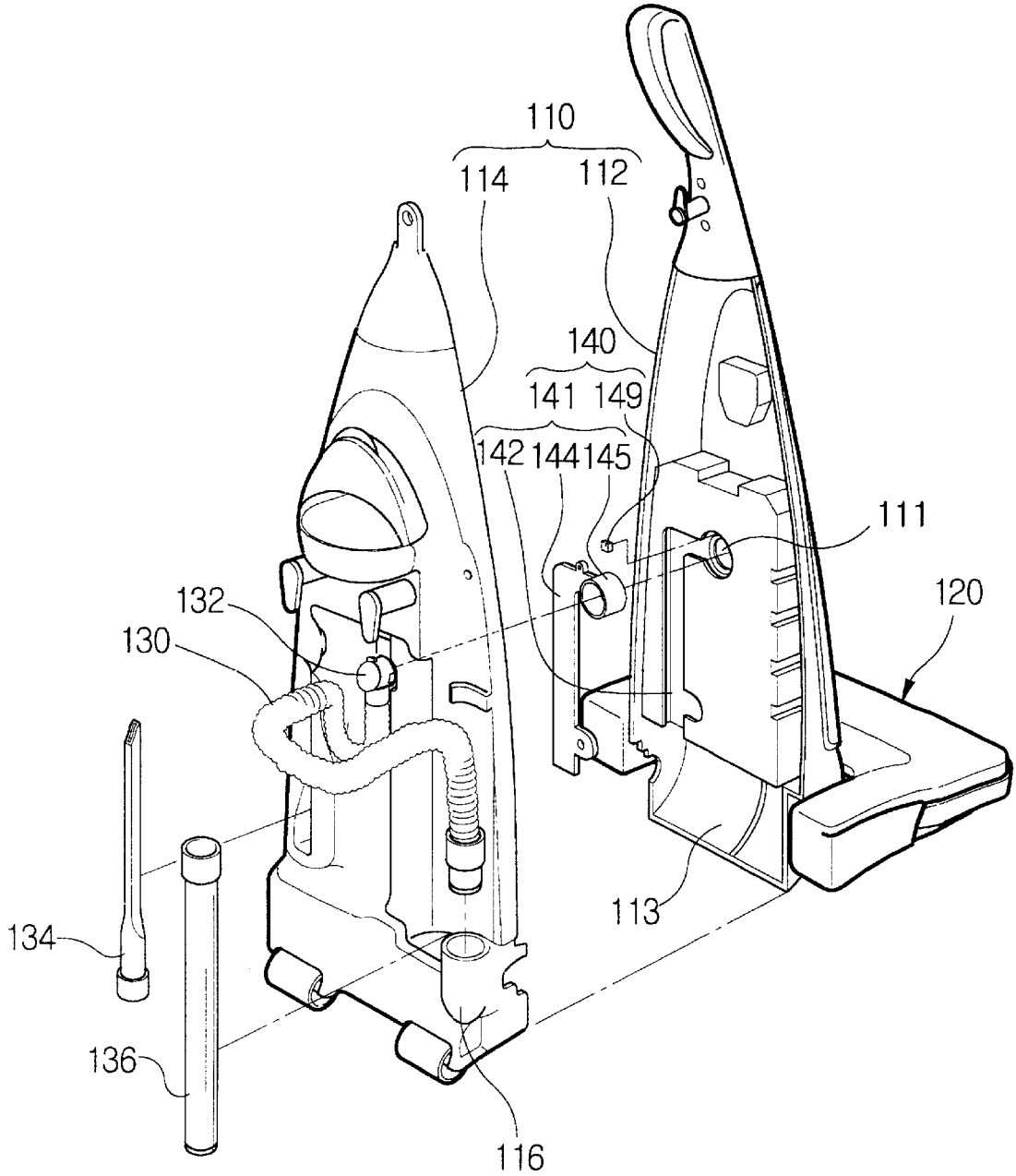
FIG. 2 is a partially exploded perspective view of a vacuum cleaner according to a preferred embodiment of the present invention.

As shown in FIG. 2, the vacuum cleaner built according to the preferred embodiment of the fi present invention includes a body 110, a suction brush 120, a suction hose 130, and an exterminating section 140.

Figure 1:
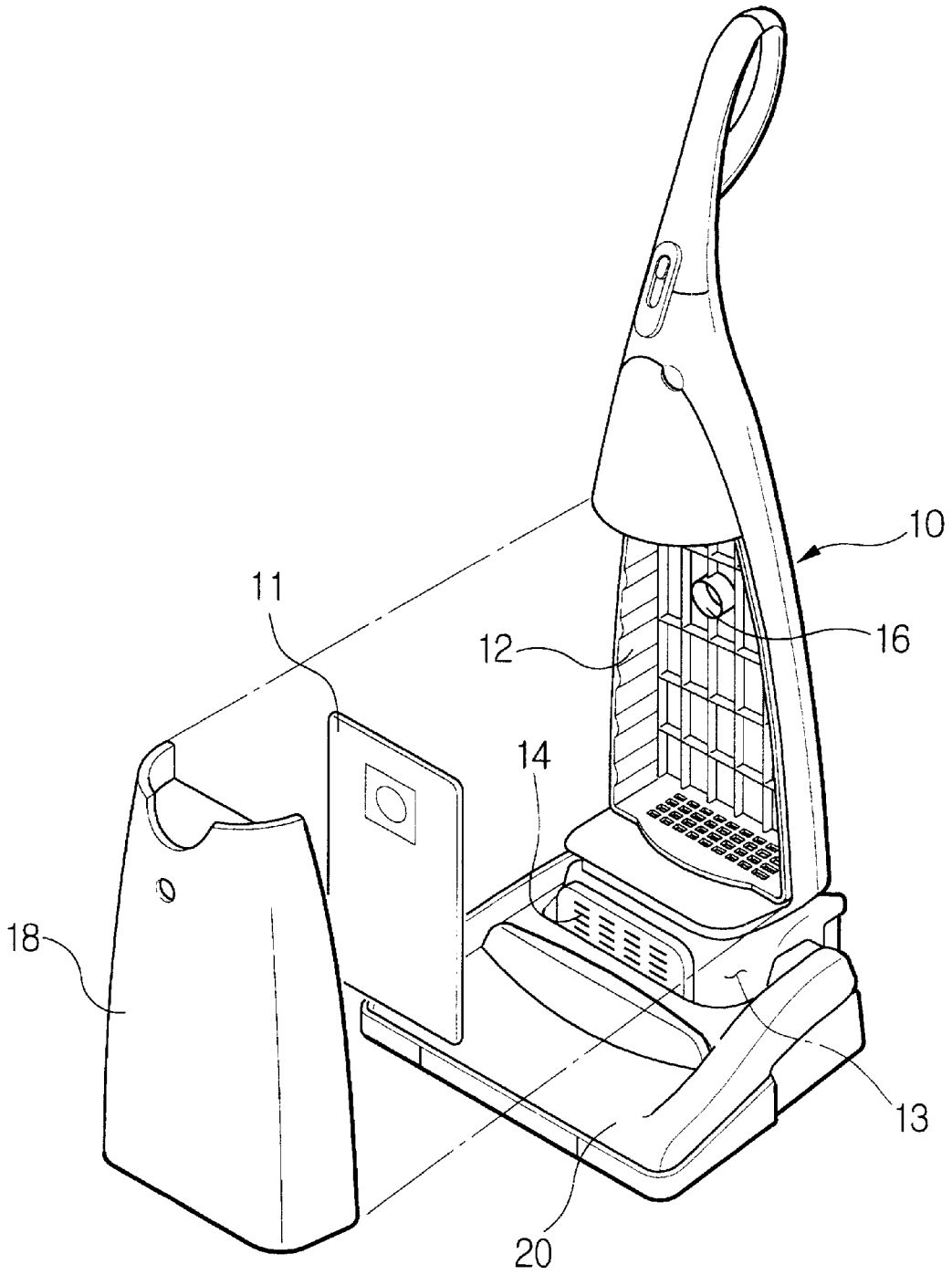
FIG. 1 (PRIOR ART)
FIG. 1 is a perspective view for schematically showing one example of a conventional vacuum cleaner.

The body 110 includes a front body 112 and a rear body 114. The front body 112 includes the dust collecting chamber 12 (See FIG. 1) covered up tightly by the front cover 18 (See FIG. 1) which has the filter 11 (See FIG. 1) mounted inside. Also, on the lower side of the front body 112, an accommodating chamber 113 for receiving a motor (not shown) that generates the suction force is formed. The dust collecting chamber 12 and the accommodating chamber 113 are communicated with each other, and an exhaust port (not shown) is formed on the front side of the front body 112 to let the air of the accommodating chamber 113 outside. Accordingly, as the motor is driven, the suction force is generated in the dust collecting chamber 12. Meanwhile, when the front and rear bodies 112 and 114 are coupled with each other, a suction port 115 (See FIG. 4) formed on the rear body 114 is connected with the dust collecting chamber 12 through a communicating hole 111 formed on the front body 112.

The suction brush 120 is connected to the lower side of the body 110. Further, one end of the suction hose 130 is detachably connected to the suction port 115 of the rear body 114 by a damper 132, and the other end of the suction hose 130 is detachably connected to a connecting tube 116 formed on the lower side of the rear body 114. Accordingly, the air sucked through the suction brush 120 is guided into the dust collecting chamber 12 through the suction hose 130. As necessary, the other end of the suction hose 130 can be separated from the connecting tube 116, and various accessories 134 and 136 can be attached.

Meanwhile, one of the main portions of the present invention, i.e., the exterminating section 140 includes a hot air circulating duct 141, a shutter member 146, an operating switch 148, and a temperature sensor 149.

Figure 3:
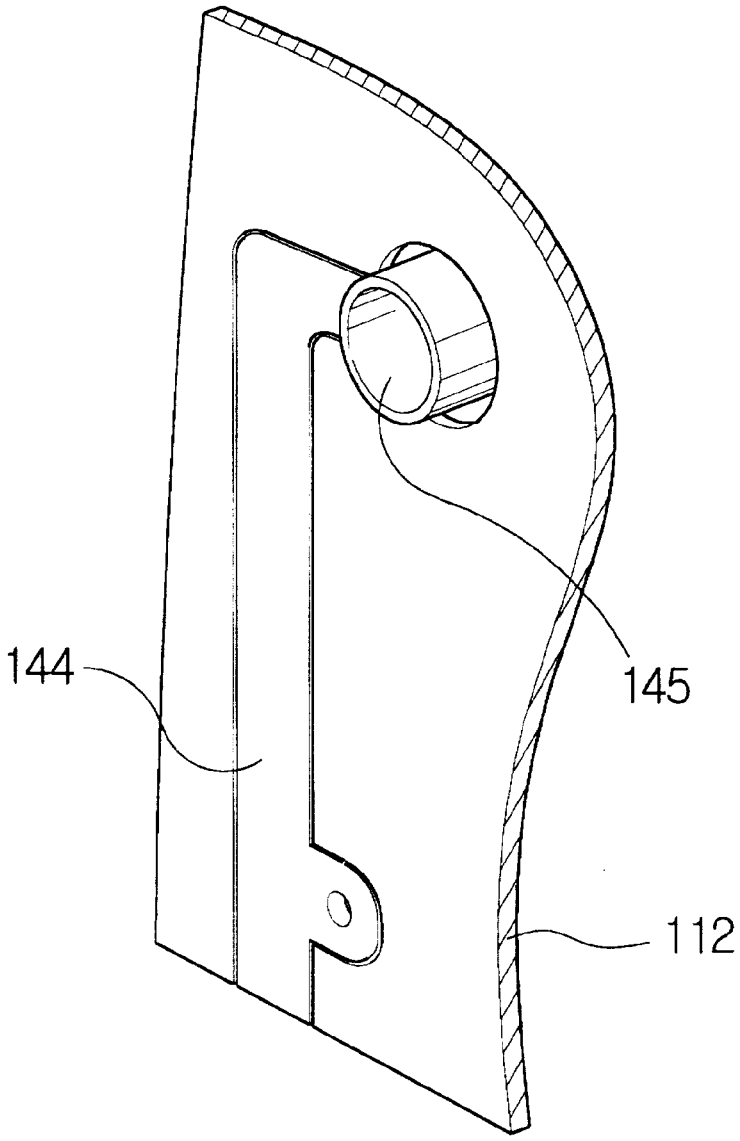
FIG. 3 is an enlarged perspective view that shows one of the main portions of the present invention, i.e., a hot air circulating duct of FIG. 2.

As shown in FIGS. 2 and 3, the hot air circulating duct 141 includes a duct groove 142 formed on the rear side of the front body 112, a duct cover 144 for covering the duct groove 142, and a guiding tube 145 formed on the end of the duct cover 144. The duct groove 142 is formed such that the duct groove 142 extends from the accommodating chamber 113 to the communicating hole 111 of the dust collecting chamber 12, and is tightly covered up by the duct cover 144 to form an air passage of a certain length. The guiding tube 145 is located between the communicating hole 111 of the front body 112 and the suction port 115 of the rear body 114, connecting the suction port 115 and the dust collecting chamber 12. Here, the rear body facing portion of the guiding tube 145 is spaced from the front surface of the rear body 114 at a certain distance. Accordingly, a shutter member 146, which will be described in a later part of this description, can be moved. As the clamper 132 of the suction hose 130 is connected to the suction port 115, an end of the damper 132 is inserted into the guiding tube 145.

Figure 4:
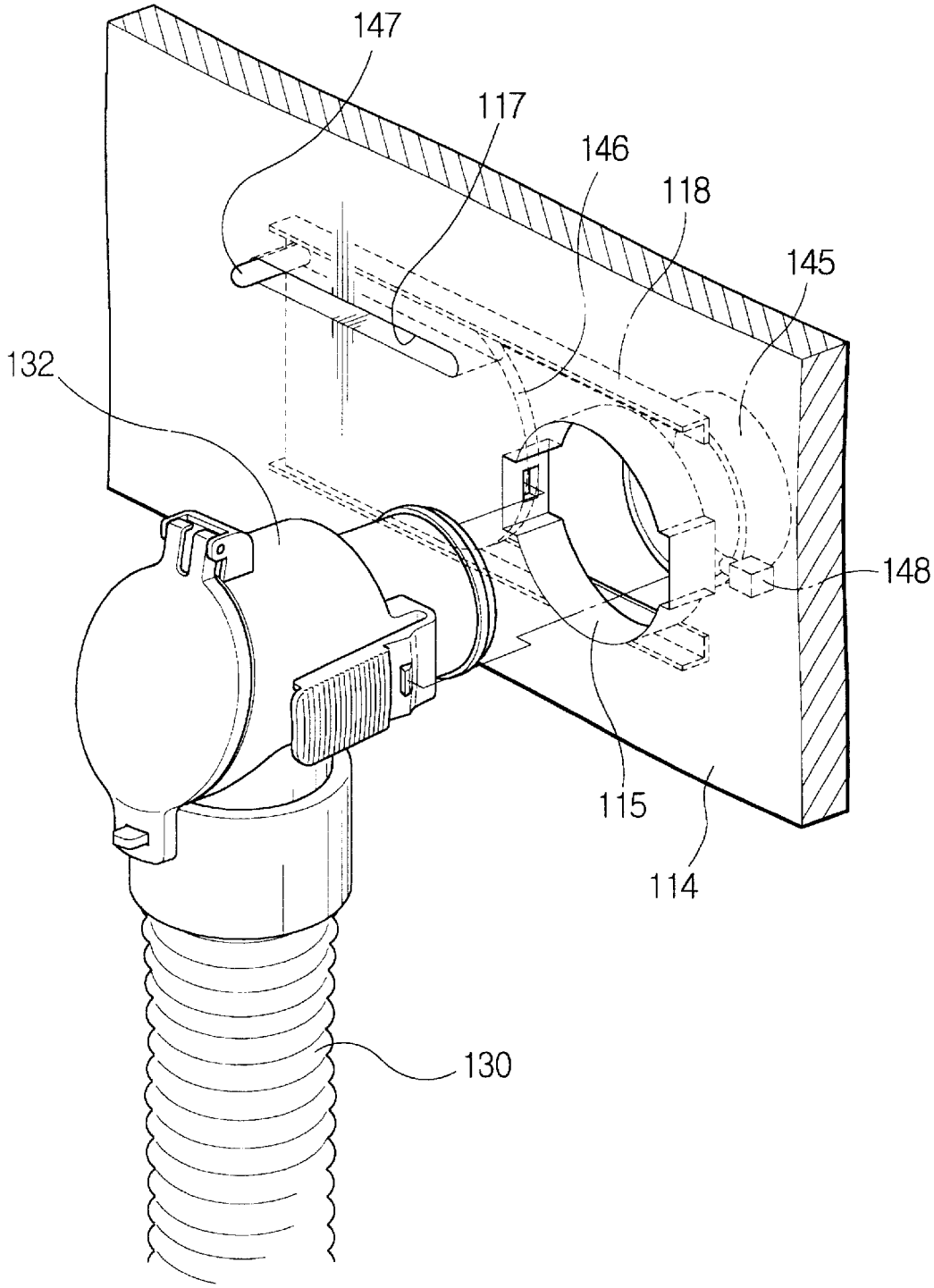
Figure 5:
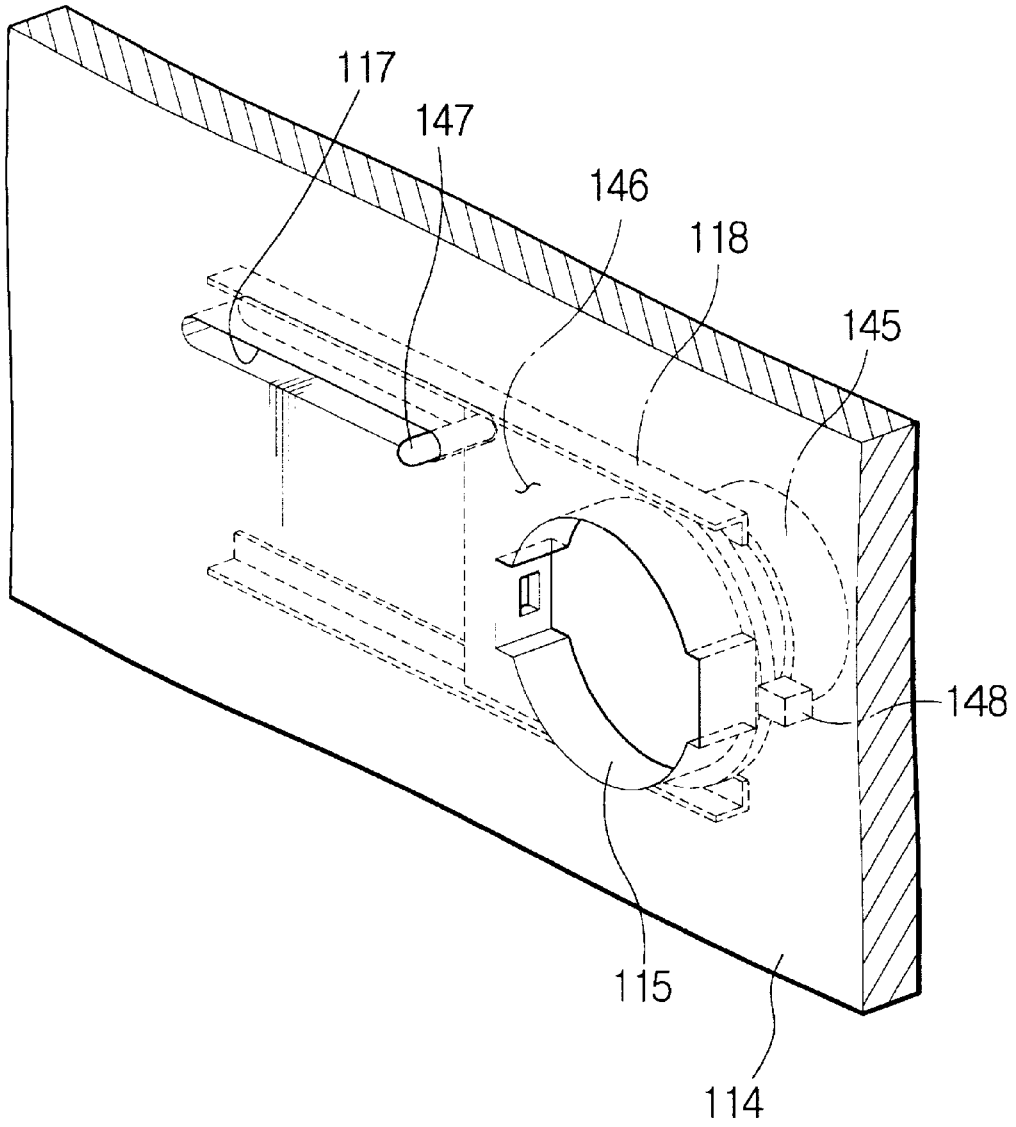

As shown in greater detail in FIGS. 4 and 5, the shutter member 146 is movably disposed on the front surface of the rear body 114 to be slid in a horizontal direction, thereby opening/closing the suction port 115. A guiding long hole 117 of a certain length is formed on the upper side of the suction port 115 of the rear body 114 in a horizontal direction, and an operating lever 147 protrudes from one side of the shutter member 146 and passes through the guiding long hole 117 toward the rear side of the rear body 114. The operating lever 147 is moved along the guiding long hole 117, and by the movement of the operating lever 147, the shutter member 146 is slidably moved. The reference numeral 118 denotes a guiding member for supporting the shutter member 146, and for guiding the sliding movement of the shutter member 146.

The operating switch 148 is disposed on the rear body 114, between the suction port 115 and the guiding tube 145, and opposite the shutter member 146. The operating switch 148 is a micro-switch which is turned on/off by the sliding movement of the shutter member 146. When the shutter member 146 is moved to the suction port opening position as shown in FIG. 4, the operating switch 148 is turned off, and when the shutter member 146 is moved to the suction port closing position as shown in FIG. 5, the operating switch 148 is turned on. The operating switch 148 is connected to the motor accommodated in the accommodating chamber 113. Accordingly, the motor is driven in accordance with the turning on/off of the operating switch 148.

The temperature sensor 149 is disposed at a certain part of an inner circumference of the communicating hole 111 of the front body 112, to detect the temperature of the air which is guided into the dust collecting chamber 12 through the guiding tube 145. The temperature sensor 149 is connected to the motor of the accommodating chamber 113 through an electric wire. When the detected temperature exceeds a predetermined degree, the motor is stopped. Here, the predetermined temperature preferably ranges from 63–37° C., and more preferably 65° C.

The regular operation of the vacuum cleaner built as described above according to the preferred embodiment of the present invention is the same as the operation of the conventional vacuum cleaner. That is, as the motor is driven, the outside air is sucked through the suction brush 120, the suction hose 130, the suction port 115, the guiding tube 145, the communicating hole 111, and to the dust collecting chamber 12. The air sucked into the dust collecting chamber 12 passes through the filter 11 and the motor of the accommodating chamber 113, and is let out through the exhaust port 14. When the air passes through the filter 11, the foreign substances in the air are filtered out by the filter 11.

Meanwhile, while performing the exterminating function, the hose damper 132 of the suction hose 130 is separated from the suction port 115 of the body 110. Then, by moving the operating lever 147 along the guiding long hole 117, the shutter member 146 is slid together with the operating lever 147 in the horizontal direction. When the shutter member 146 is completely moved, as shown in FIG. 5, the suction port 115 is closed, and the operating switch 148 is turned on, thereby driving the motor, since the end of the shutter member 146 presses the contact point of the operating switch 148.

As the motor is driven, the air in the dust collecting chamber 12 is drawn into the accommodating chamber 113. Here, since the suction port 115 is closed by the shutter member 146, the outside air is not sucked into the dust collecting chamber 12. Accordingly, the interior of the dust collecting chamber 12 is subject to negative pressure which is lower than the external atmospheric pressure. As a result, the air drawn into the accommodating chamber 113 re-circulates to the dust collecting chamber 12 through the hot air circulating duct 141 without being let out through the exhaust port 14 (See FIG. 1). As the air in the dust collecting chamber 12 re-circulates within the body 110 of the vacuum cleaner, it is heated due to the heat generated from the motor. Then the air is heated approximately beyond 55° C., and the bacteria or bugs with the dirt or foreign substances in the air or at the filter 11 are sterilized for about 3–4 minutes. In such a situation, when the temperature of the air exceeds a predetermined limit of the temperature sensor 149, the motor is stopped by the temperature sensor 149, and the sterilization is finished.

With the vacuum cleaner according to the present invention, the bacteria or the bugs living in the dust collecting chamber or on the filter are exterminated by the hot air which is generated from the motor and is re-circulated through the hot air circulating duct. Accordingly, the risk of catching disease due to the various bacteria or the bugs living in the body of the vacuum cleaner is significantly reduced.

As stated above, a preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. A vacuum cleaner comprising:

a body having front and rear bodies coupled with each other, said body forming a dust collecting chamber with a filter mounted therein, and an accommodating chamber for accommodating a motor for generating a suction force, the rear body having a suction port formed thereon, and the front body having a communicating hole formed on said dust collecting chamber, and aligned with the suction port of the rear body for connecting the suction port and the dust collecting chamber;

a suction brush connected to a lower portion of the body for sucking in outside air with various foreign substances sucked from a cleaned surface as the motor is driven;

a suction hose disposed between the suction brush and the suction port for guiding the outside air with various foreign substances sucked through the suction brush into the dust collecting chamber of the body; and means for exterminating various bacteria and bugs living in the dust collecting chamber and on the filter with hot air which is heated by the motor and re-circulated to the dust collecting chamber.

2. The vacuum cleaner as claimed in claim 1, wherein the exterminating means comprises:

an operating switch for selecting hot air circulation for an exterminating operation;

a hot air circulating duct disposed on a rear surface of the front body, connecting the accommodating chamber with the dust collecting chamber of the body, for guiding the air in the accommodating chamber into the dust collecting chamber; and a shutter section for circulating the air of the dust collecting chamber within the body of the vacuum cleaner by closing the suction port so as to prevent the outside air from being sucked into the dust collecting chamber through the suction port when the exterminating function is selected.

3. The vacuum cleaner as claimed in claim 2, further comprising a temperature sensor for detecting the temperature of the air which circulates within the body of the vacuum cleaner, and for stopping the operation of the motor when detecting the temperature of the air above a predetermined degree, thereby canceling the exterminating function.

4. The vacuum cleaner as claimed in claim 3, wherein the predetermined temperature ranges from 63° C. to 67° C.

5. The vacuum cleaner as claimed in claim 2, wherein the hot air circulating duct comprises:

a duct groove extending along the rear surface of the front body from the accommodating chamber to the communicating hole; and a duct cover for forming an air passage extending from the accommodating chamber to the dust collecting chamber by tightly covering up the duct groove, the duct cover having a guiding tube integrally formed on an upper end thereof which is positioned between the suction port of the rear body and the communicating hole of the front body.

6. The vacuum cleaner as claimed in claim 5, wherein the shutter section comprises:

a shutter member movably disposed on the rear body to be slid between the suction port of the rear body and the guiding tube of the duct cover for selectively closing the suction port;

a pair of guiding members formed on the rear body for guiding the sliding movement of the shutter member; and an operating lever protruded from one side of the shutter member and passed through a guiding long hole formed on the rear body for allowing a user to slide the shutter member by holding the operational lever.

7. The vacuum cleaner as claimed in claim 6, wherein the operating switch is turned on/off by the sliding movement of the shutter member.

* * * * *